US008123042B2

(12) United States Patent
Tran

(10) Patent No.: US 8,123,042 B2
(45) Date of Patent: Feb. 28, 2012

(54) METHYL ISOBUTYL CARBINOL MIXTURE AND METHODS OF USING THE SAME

(75) Inventor: Bo L. Tran, Chicago, IL (US)

(73) Assignee: Nalco Company, Naperville, IL (US)

( * ) Notice: Subject to any disclaimer, the term of this patent is extended or adjusted under 35 U.S.C. 154(b) by 1140 days.

(21) Appl. No.: 11/764,461

(22) Filed: Jun. 18, 2007

(65) Prior Publication Data

US 2008/0308467 A1 Dec. 18, 2008

(51) Int. Cl.

| | |
|---|---|
| ***B03B 1/04*** | (2006.01) |
| ***B03D 1/008*** | (2006.01) |
| ***B03D 1/02*** | (2006.01) |

(52) U.S. Cl. ..... 209/166; 252/61

(58) Field of Classification Search ..... 209/166; 252/61

See application file for complete search history.

(56) References Cited

U.S. PATENT DOCUMENTS

| | | | | | |
|---|---|---|---|---|---|
| 3,675,773 | A | * | 7/1972 | Chemtob et al. | 209/166 |
| 3,953,517 | A | | 4/1976 | Schmitt et al. | |
| 4,208,487 | A | * | 6/1980 | Wang et al. | 521/117 |
| 4,214,983 | A | * | 7/1980 | Rule | 209/166 |
| 4,268,380 | A | * | 5/1981 | Shaw | 209/167 |
| 4,462,898 | A | * | 7/1984 | Parlman et al. | 209/166 |
| 4,587,013 | A | * | 5/1986 | Nagaraj et al. | 209/167 |
| 5,316,664 | A | * | 5/1994 | Gregoli et al. | 208/390 |
| 5,925,796 | A | | 7/1999 | Bassett et al. | |

* cited by examiner

*Primary Examiner* — Thomas M Lithgow

(74) *Attorney, Agent, or Firm* — Benjamin E. Carlsen; Michael B. Martin

(57) ABSTRACT

Methods and compositions for separating materials are provided. The present invention provides a method of separating a first material from a second material such as mixing the first material and the second material in a slurry with a beneficiation composition. The beneficiation composition can comprise methyl isobutyl carbinol mixture derived from a methyl isobutyl ketone and/or methyl isobutyl carbinol manufacturing process. Additionally air bubbles can be provided in the slurry to form bubble-particle aggregates with the first material and the bubble-particle aggregates can be allowed to be separated from the second material.

16 Claims, No Drawings

METHYL ISOBUTYL CARBINOL MIXTURE AND METHODS OF USING THE SAME

BACKGROUND

The present invention relates generally to beneficiation technologies. More specifically, the present invention relates to beneficiation compositions and methods of using the same.

Beneficiation is a method of separating useful matter from waste. Commonly, beneficiation uses the difference in the hydrophobicity of the respective components. During this process, the mineral ore is comminuted to a certain small size and slurried with water. The slurry is introduced into a flotation apparatus purged with air. The air bubbles formed preferentially attach to the hydrophobic particles of the slurry, making them float to the top of the apparatus. The floated particles are collected, dewatered, and accumulated as a sellable final product. The hydrophilic particles tend to migrate to the bottom of the contact vessel from where they can be removed as tailings and processed into waste impoundments. In other processes, such as reverse flotation, the sellable final product may migrate to the bottom.

To facilitate beneficiation, several types of conventional reagents are used such as frothers, collectors, promoters and conditioners. Nevertheless, these reagents can be expensive thereby reducing the cost-effectiveness of the beneficiation processes.

It is therefore desirable to provide and utilize cost-effective beneficiation compositions.

SUMMARY

Flotation processes are one of the most widely used methods of separating the valuable material from valueless material present. For example, in a flotation process, the fine particles are dispersed in water or other suitable solution and small air bubbles are introduced to the slurry so that hydrophobic particles can be selectively collected on the surface of the air bubbles and exit the slurry (e.g. by rising to the surface) while hydrophilic particles are left behind. The hydrophilic particles can also sink to the bottom of the slurry to be collected as sludge.

The MIBC mixture can be used to separate materials, for example, in any suitable flotation process. It should be appreciated that the desired final products can rise to the surface during flotation and/or sink to the bottom, such as in reverse flotation processes. For example, during silica flotation processes, the desired product can sink to the bottom of the slurry and the waste product can rise to the top of the slurry.

The present invention provides a method of separating a first material from a second material. In one embodiment the method can comprise mixing the first material and the second material in a slurry with a beneficiation composition. The beneficiation composition can comprise a methyl isobutyl carbinol (MIBC) mixture. Air bubbles can be provided in the slurry to form bubble-particle aggregates with the first material and the bubble-particle aggregates can be allowed to be separated from the second material.

In one embodiment, the MIBC mixture contains MIBC, alcohols, and ketones.

In another embodiment, the MIBC mixture can be derived from the manufacture of methyl isobutyl ketone (MIBK) and/or MIBC. The MIBC mixture is co-produced in the manufacturing process.

The MIBC mixture comprises about 50 to about 90 weight percent of MIBC, about 5 to about 25 weight percent of alcohols and about 5 to about 25 weight percent of ketones in-additional embodiments.

In an embodiment, the alcohols comprise one or more components selected from a group consisting of diisobutyl carbinol and diisobutyl carbinol isomers and combinations thereof.

In an embodiment, the ketones comprise one or more components selected from a group consisting of diisobutyl ketone, diisobutyl ketone isomers and 3,3,5 trimethylcyclohexanone and combinations thereof.

In an embodiment, the MIBC mixture can be blended with existing beneficiation compositions to improve effectiveness.

In another embodiment, the present invention provides a method of separating hydrophobic and hydrophilic particles in an aqueous slurry. For example, the method can comprise adding a beneficiation composition to the aqueous slurry to stabilize the bubble formation. The beneficiation composition can comprise a MIBC mixture derived from the manufacturing of MIBK and/or MIBC. The hydrophobic particles attach onto the surface of the stabilized air bubbles, forming bubble-particle aggregates that can float to the surface of the aqueous slurry.

The present invention provides an effective methods of separating two or more materials.

The present invention also provides compositions used to stabilize air bubbles in flotation processes resulting in improved results.

DETAILED DESCRIPTION

The present invention relates generally to beneficiation technologies. More specifically, the present invention relates to beneficiation compositions and methods of using said beneficiation composition.

The term "beneficiation" should be understood to mean separating useful matter from waste, particularly hydrophobic substances from hydrophilic substances. Suitable processes for accomplishing this include, but are not limited to, flotation, reverse flotation and similar technologies.

The term "MIBC mixture" should be understood to mean co-products generated from MIBK and/or MIBC manufacturing processes.

The present invention provides a beneficiation compositions comprising co-products from MIBK and/or MIBC manufacturing processes. The co-products can comprise mixtures of MIBC and other alcohols and ketones. The alcohols and ketones contain primarily from nine to twenty carbon atoms.

The MIBC mixture of the present invention surprisingly improves recovery of beneficiation technologies, for example, flotation processes. The MIBC mixture can be used to supplement or replace conventional beneficiation compositions used in flotation processes.

Generally, MIBK is produced from acetone. The first step involves the aldol condensation to form diacetone alcohol. The diacetone is then dehydrated to form mesityl oxide. In the last step the mesityl oxide is hydrogenated to MIBK. Theoretical yield is about 89%. Varying amounts of MIBC mixtures are co-produced. MIBC is generally produced by the hydrogenation of MIBK.

MIBK is used primarily as a solvent in the coating industry. MIBC is used primarily as a lube oil additive. MIBC is also widely used as a frother in flotation processes recovering minerals. MIBC stabilizes the bubbles allowing the hydrophobic minerals to attach themselves to the bubbles. However, MIBC cost has escalated recently due to the high cost of petroleum hydrocarbons. The present invention offers an economical alternative that is effective for a variety of beneficiation technologies.

In one embodiment, the MIBC mixture from MIBK manufacturing can—comprise of MIBC, other alcohols and ketones. The alcohols and ketones can include diisobutyl carbinol, diisobutyl ketone, and 3,3,5 trimethylcyclohexanone, and their isomers.

The above composition suggests that the MIBC mixture can make a perfect flotation reagent. In flotation lab tests the MIBC mixture was effective in stabilizing air bubbles.

In an alternative embodiment, the MIBC mixtures can further be mixed with additives to supplement and/or improve the separation properties of the beneficiation compositions. Such additives can include other flotation reagents. Other flotation reagents include but are not limited to, light hydrocarbon oils, petroleum ethers, fatty acid methyl esters, fatty acids, c4-c20 alcohols, c4-c20 aldehydes, c4-c20 esters, phosphate, sulfate, sulfonate, amine salt, xanthates, hydrophobic polymers, and combinations thereof.

The hydrophobic polymers can include, for example, polymethylhydrosiloxanes, polysilanes, polyethylene derivatives, and hydrocarbon polymers generated by both ring-opening metathesis and methalocene catalyzed polymerization.

The light hydrocarbon oils include diesel oil, kerosene, gasoline, petroleum distillate, turpentine, naphtanic oils, etc.

In a further embodiment, the present invention provides methods of stabilizing the bubbles in certain beneficiation processes. For example, the beneficiation composition comprising the MIBC mixture can be useful in beneficiation of the following materials including, but not limited to coal, sand and gravel, phosphates, diamonds, precious metals, and other mineral ores or man-made matter. In alternative embodiments, the beneficiation composition can be used in processes to increase the bubble stability, particularly in applications such as flotation resulting in the beneficiation of coal, sand and gravel, phosphates, diamonds, precious metals, and other mineral ores or man-made matter. The beneficiation composition can also be used in conjunction with other suitable frothers, flotation collectors and promoters.

An additional embodiment of the present invention provides a method of separating a first material from a second material. For example, the method can comprise mixing the first material and the second material in a slurry with a beneficiation composition. The beneficiation composition can comprise MIBC mixtures derived from a MIBK or MIBC manufacturing process. Air bubbles can be provided in the slurry to form bubble-particle aggregates with the first material; the bubble-particle aggregates can then be separated from the second material. The beneficiation composition can further include other frothers, promoter, and/or collector mixed with the MIBC mixture.

The present invention additionally provides a method of separating hydrophobic and hydrophilic particles in an aqueous slurry. For example, the method can comprise adding a beneficiation composition to the aqueous slurry to increase the stability of the bubbles. The beneficiation composition can comprise MIBC mixtures derived from a MIBK or MIBC manufacturing process. The aqueous slurry can be mixed with the MIBC mixtures. Air bubbles can be provided to the aqueous slurry so that the hydrophobic particles collect on the surface of the air bubbles forming bubble-particle aggregates. The bubble-particle aggregates can be allowed to float to the surface of the aqueous slurry to be separated from the hydrophilic particles.

The materials to be separated can have any suitable size. By example and not limitation, the materials can range from 2 mm to 0.04 mm in size. The slurry can contain up to 50% solids. Any suitable mechanical or chemical forces can be used to bring the slurry particles in contact with the beneficiation compositions of the present invention. The floated product and the non-floated tailings can be collected from the present methods.

EXAMPLES

By way of example and not limitation, the following examples are illustrative of various embodiments of the present invention.

In example 1 the beneficiation composition of the present invention comprises a blend of the MIBC mixtures and 1-propene hydroformylation product. The 1-propene hydroformylation product is a mixture of the C4-C18 alcohols, aldehydes, and esters, and is generally used as a frother in flotation operations. The beneficiation composition is prepared from about 30% by weight of the MIBC mixtures and 70% by weight of 1-propene hydroformylation product. It was compared against another flotation reagent consisting of 30% by weight of MIBC and 70% by weight of 1-propene hydroformylation product.

A sample of coal slurry from a coal preparation plant was floated in the laboratory using a Denver flotation machine. The tests were designed to determine the utility of the MIBC mixture blended with a 1-propene hydroformylation product. The collector used was diesel. The MIBC mixture was the obtained from the manufacture of MIBK and MIBC.

Example 1

| Diesel collector, 0.567 lb/ton solids | | | | |
|---|---|---|---|---|
| | Frother | | | |
| | MIBC and 1-propene hydroformylation product | | MIBC mixture and 1-propene hydroformylation product | |
| Lb/ton solids | Conc. Ash (%) | Combustible Recovery (%) | Conc. Ash (%) | Combustible Recovery (%) |
| 0.326 | 5.1 | 78.4 | 5.7 | 79.6 |
| 0.326 | 6.1 | 78.5 | 5.7 | 79.0 |

The above data shows combustible recovery improved when utilizing the MIBC mixture.

Example 2

The MIBC mixture was used in place of MIBC at a coal flotation process facility in which the recovery of fine coal noticeably increased from about 85% to 89% with the use of the claimed invention.

It should be understood that various changes and modifications to the embodiment described herein will be apparent to those skilled in the art. Such changes and modifications can be made without departing from the spirit and scope of the present subject matter and without diminishing its intended advantages. It is therefore intended that such changes and modifications be covered by the appended claims.

It is claimed:

1. A method of separating a first material from a second material, the method comprising: Mixing the first material and the second material in a slurry with a beneficiation composition, wherein the beneficiation composition comprises a MIBC mixture and containing a mixture of MIBC and about 5 to about 50 weight percent of C9 to C18 ketones.

2. The method of claim 1 where air bubbles are provided in the slurry to form bubble-particle aggregates with the first material; and allowing the bubble-particle aggregates to be separated from the second material.

3. The method of claim 1, wherein the MIBC mixture comprises MIBC, 2,6,8-trimethyl-4-nonanone, and one or more components selected from a group consisting of 2,6-dimethyl-4-heptanol, 2,6-dimethyl-4-heptanone, 3,3,5-trimethyl-1-1 cyclohexanone, 4,6-dimethyl-2-heptanone, 4,6-dimethyl-2-heptanol, and combinations thereof.

4. The method of claim 2, wherein the MIBC mixture is blended with one of more components selected from a group consisting of light hydrocarbon oils, petroleum ethers, fatty acids methyl esters, fatty acids, c4-c20 alcohols, c4-c20 aldehydes, c4-c20 esters, phosphate, sulfate, sulfonate, amine salt, xanthates, hydrophobic polymers, and combinations thereof.

5. The method of claim 3 wherein the MIBC mixture comprises about 50 to about 90 weight percent of MIBC.

6. The method of claim 5 wherein the MIBC mixture comprises about 5 to about 25 weight percent of C9 alcohols.

7. The method of claim 5 wherein the MIBC mixture comprises about 5 to about 25 weight percent of C9 ketones.

8. The method of claim 1 wherein the beneficiation composition is comprised of a MIBC mixture derived from a MIBK and/or MIBC manufacturing process.

9. The method of claim 5 wherein the MIBC mixture comprises about 5 to about 50 weight percent of C9 to C18 alcohols.

10. The method of claim 8, wherein the MIBC mixture comprises MIBC and one or more components selected from a group consisting of 2,6-dimethyl-4-heptanol, 2,6-dimethyl-4-heptanone, 3,3,5-trimethyl-1-1 cyclohexanone, 4,6-dimethyl-2-heptanone, 4,6-dimethyl-2-heptanol, 2,6,8-trimethyl-4-nonanone, and combinations thereof.

11. The method of claim 8, wherein the MIBC mixture is blended with one or more components selected from a group consisting of light hydrocarbon oils, petroleum ethers, fatty acid methyl esters, fatty acids, c4-c20 alcohols, c4-c20 aldehydes, c4-c20 esters, phosphate, sulfate, sulfonate, amine salt, xanthates, hydrophobic polymers and combinations thereof.

12. The method of claim 10, wherein the MIBC mixture comprises about 50 to about 90 weight percent of MIBC.

13. The method of claim 12, wherein the MIBC mixture comprises about 5 to about 50 weight percent of C9 to C18 alcohols.

14. The method of claim 12, wherein the MIBC mixture comprises about 5 to about 50 weight percent of C9 to C18 ketones.

15. The method of claim 12 wherein the MIBC mixture comprises about 5 to about 25 weight percent of C9 ketones.

16. The method of claim 12 wherein the MIBC mixture comprises about 5 to about 25 weight percent of C9 alcohols.

* * * * *